US009127381B2

(12) United States Patent
Gao et al.

(10) Patent No.: US 9,127,381 B2
(45) Date of Patent: Sep. 8, 2015

(54) WRAPPABLE TEXTILE SLEEVE WITH EXTENDABLE ELECTRO-FUNCTIONAL YARN LEADS AND METHOD OF CONSTRUCTION THEREOF

(71) Applicant: Federal-Mogul Powertrain, Inc., Southfield, MI (US)

(72) Inventors: Tianqi Gao, Exton, PA (US); Zhonghuai Zhang, Pottstown, PA (US); Cassie M. Malloy, Trappe, PA (US)

(73) Assignee: Federal-Mogul Powertrain, Inc., Southfield, MI (US)

( * ) Notice: Subject to any disclaimer, the term of this patent is extended or adjusted under 35 U.S.C. 154(b) by 16 days.

(21) Appl. No.: 14/203,162

(22) Filed: Mar. 10, 2014

(65) Prior Publication Data

US 2014/0305536 A1 Oct. 16, 2014

Related U.S. Application Data

(60) Provisional application No. 61/774,833, filed on Mar. 8, 2013.

(51) Int. Cl.

| | |
|---|---|
| ***D03J 3/00*** | (2006.01) |
| ***H05B 3/03*** | (2006.01) |
| ***D03D 1/00*** | (2006.01) |
| ***D03D 13/00*** | (2006.01) |
| ***D03D 15/02*** | (2006.01) |

(Continued)

(52) U.S. Cl.

CPC ..... *D03J 3/00* (2013.01); *D03D 1/0035* (2013.01); *D03D 1/0088* (2013.01); *D03D 3/02* (2013.01); *D03D 13/00* (2013.01); *D03D 15/02* (2013.01); *D03D 27/06* (2013.01); *H05B 3/03* (2013.01); *D10B 2101/20* (2013.01); *D10B 2401/16* (2013.01); *D10B 2401/20* (2013.01); *H05B 3/345* (2013.01); *H05B 3/347* (2013.01)

(58) Field of Classification Search

None

See application file for complete search history.

(56) References Cited

U.S. PATENT DOCUMENTS 857,367 A 6/1907 Shore
2,412,843 A * 12/1946 Spraragen ..... 219/545

(Continued)

FOREIGN PATENT DOCUMENTS

DE 102006036405 A1 8/2007

OTHER PUBLICATIONS

International Search Report mailed Jun. 27, 2014 (PCT/US2014/022777).

*Primary Examiner* — Joseph M Pelham

(74) *Attorney, Agent, or Firm* — Robert L. Stearns; Dickinson Wright, PLLC

(57) ABSTRACT

A wrappable textile sleeve and method of construction thereof is provided. The sleeve has a wall of interlaced yarn with opposite edges extending lengthwise between opposite ends. The opposite edges of the wall are wrappable to overlap one another to form a tubular cavity. At least one electro-functional member extends lengthwise between the opposite ends of the wall. The at least one electro-functional member is interlaced in the wall at a plurality of nodes and forms at least one unrestrained loop intermediate the opposite ends of the sleeve. The at least one electro-functional member has a straightened length that is greater than the straightened length of the sleeve, thereby allowing opposite ends of the at least one electro-functional member to be pulled axially outwardly away from the ends of the sleeve to form leads for attachment to a power source, which in turn constricts the at least one loop.

20 Claims, 3 Drawing Sheets

(51) Int. Cl.

| | |
|---|---|
| ***D03D 27/06*** | (2006.01) |
| ***D03D 3/02*** | (2006.01) |
| *H05B 3/34* | (2006.01) |

(56) References Cited

U.S. PATENT DOCUMENTS

| | | | | | |
|---|---|---|---|---|---|
| 2,938,992 | A | | 5/1960 | Crump | |
| 2,945,115 | A | | 7/1960 | Weitzel | |
| 3,425,020 | A | * | 1/1969 | Takeo et al. | 338/208 |
| 4,668,545 | A | * | 5/1987 | Lowe | 428/35.1 |
| 4,684,762 | A | | 8/1987 | Gladfelter | |
| 4,700,054 | A | * | 10/1987 | Triplett et al. | 219/545 |
| 4,920,235 | A | | 4/1990 | Yamaguchi | |
| 4,944,987 | A | | 7/1990 | Cordia et al. | |
| 4,983,814 | A | * | 1/1991 | Ohgushi et al. | 219/545 |
| 5,236,765 | A | * | 8/1993 | Cordia et al. | 428/192 |
| 5,484,983 | A | * | 1/1996 | Roell | 219/545 |
| 5,972,139 | A | | 10/1999 | Chu | |
| 6,020,578 | A | * | 2/2000 | Putz | 219/545 |
| 6,452,138 | B1 | * | 9/2002 | Kochman et al. | 219/549 |
| 6,639,148 | B2 | | 10/2003 | Marks | |
| 7,038,177 | B2 | * | 5/2006 | Rock | 219/529 |
| 7,190,892 | B2 | | 3/2007 | Kertesz | |
| 7,191,803 | B2 | | 3/2007 | Orr et al. | |
| 7,337,810 | B2 | | 3/2008 | Orr et al. | |
| 7,576,286 | B2 | | 8/2009 | Chen | |
| 7,687,745 | B2 | | 3/2010 | Kertesz | |
| 8,283,563 | B2 | | 10/2012 | Harris et al. | |
| 8,298,968 | B2 | * | 10/2012 | Swallow et al. | 442/229 |
| 8,669,195 | B2 | * | 3/2014 | Swallow et al. | 442/229 |
| 2002/0195260 | A1 | | 12/2002 | Marks | |
| 2005/0061802 | A1 | * | 3/2005 | Rock | 219/545 |
| 2006/0124193 | A1 | | 6/2006 | Orr | |
| 2006/0281382 | A1 | * | 12/2006 | Karayianni et al. | 442/181 |
| 2008/0233822 | A1 | * | 9/2008 | Swallow et al. | 442/185 |
| 2010/0084179 | A1 | | 4/2010 | Harris | |
| 2010/0206415 | A1 | | 8/2010 | Ellis et al. | |
| 2010/0282355 | A1 | | 11/2010 | Seyler et al. | |
| 2011/0047957 | A1 | * | 3/2011 | Richard | 57/236 |
| 2013/0020313 | A1 | * | 1/2013 | Swallow et al. | 219/545 |
| 2013/0243985 | A1 | * | 9/2013 | Furuta et al. | 428/36.1 |
| 2014/0273699 | A1 | * | 9/2014 | Zhang et al. | 442/316 |
| 2014/0374404 | A1 | * | 12/2014 | Matsumoto | 219/549 |

* cited by examiner

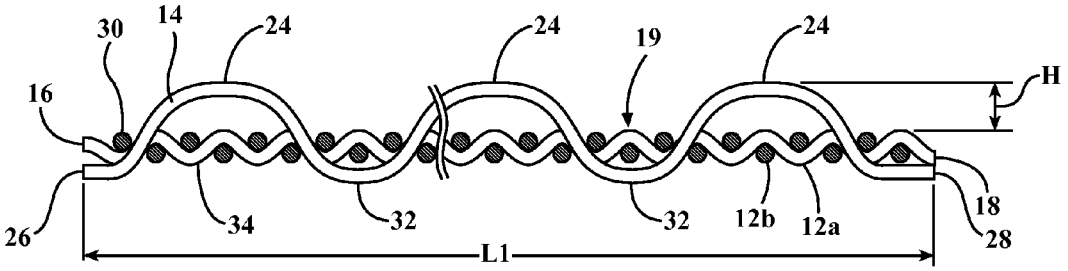
FIG. 3
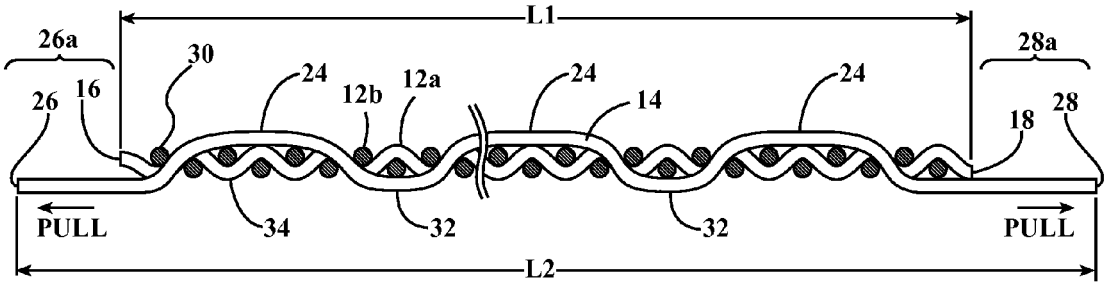
FIG. 4
FIG. 5
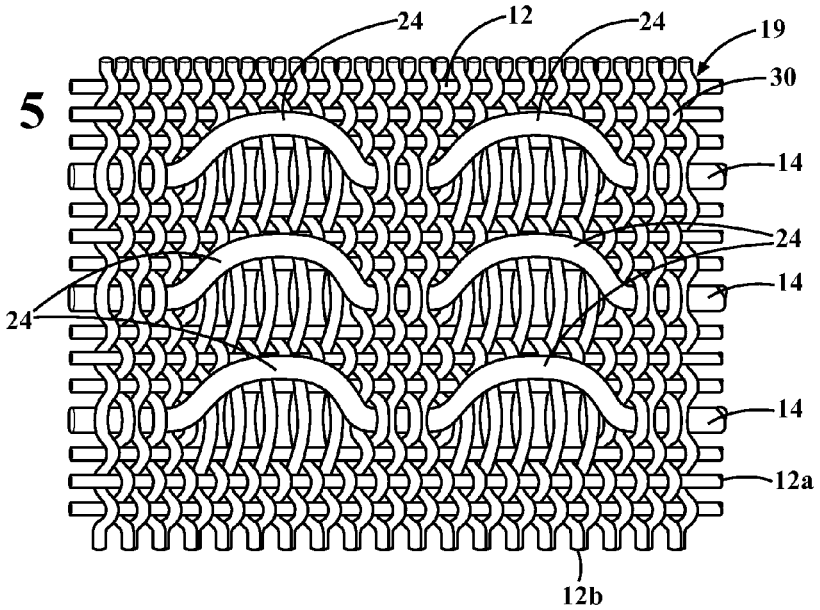

WRAPPABLE TEXTILE SLEEVE WITH EXTENDABLE ELECTRO-FUNCTIONAL YARN LEADS AND METHOD OF CONSTRUCTION THEREOF

CROSS-REFERENCE TO RELATED APPLICATION

This application claims the benefit of U.S. Provisional Application Ser. No. 61/774,833, filed Mar. 8, 2013, which is incorporated herein by reference in its entirety.

BACKGROUND OF THE INVENTION

1. Technical Field

This invention relates generally to wrappable textile sleeves used for wrapping cables, tubing and the like, and more particularly to such sleeves having one or more metallic yarns or wires incorporated into the textile sleeve material with lead ends that extend from the ends of the textile sleeve for connection to a power source and to methods of constructing such sleeves.

2. Related Art

Textile sleeves for wrapping and guiding a bundle of wires or shrouding other elongate articles, such as tubes, are sometimes fabricated to include one or more conductive or resistive metallic wires. The wires may be incorporated into the textile structure of the sleeve (e.g., woven) and may extend in the lengthwise direction with ends of the wires extending beyond the ends of the textile material to present projecting electrical leads at one or both ends of the wires for connection to a power source. One known method for making such a textile sleeve structure having conductive and/or resistive wires involves weaving the textile sleeve and integrating the one or more conductive wires as part of the woven structure during manufacture of the textile sleeve. Afterward, the ends of the textile material are trimmed back to expose the ends of the one or more wires so they end up extending beyond the trimmed ends of the textile sleeve material and can serve as leads for connection to a power source. While effective, such a process is laborious and adds to the manufacturing cost of such textile sleeves.

SUMMARY OF THE INVENTION

A wrappable textile sleeve has a wall of interlaced yarn having opposite outer and inner surfaces and opposite edges extending lengthwise along a longitudinal axis of the sleeve between opposite ends, wherein a straightened length of the sleeve spans between the opposite ends. The opposite edges of the wall are wrappable to overlap one another to form a tubular cavity. At least one electro-functional member, having a length greater than the straightened length of the sleeve, extends along the longitudinal axis between the opposite ends of the wall. The at least one electro-functional member is interlaced in the wall at a plurality of nodes and forms at least one unrestrained loop intermediate the opposite ends of the sleeve. With the at least one electro-functional member having a straightened length that is greater than the straightened length of the sleeve, opposite ends of the at least one electro-functional member can be pulled axially outwardly away from the opposite ends of the sleeve, which in turn constricts the at least one loop, to form leads for attachment to a power source.

The yarns may be monofilament or multifilament or a combination thereof. The at least one electro-functional yarn has an actual length (considering the electro-functional yarn alone apart from its woven incorporation into the textile sleeve structure) that is greater than its total effective length (straight linear distance spanned) as first incorporated into the woven textile sleeve. After the textile sleeve has been interlaced and cut to a desired length, the presence of the at least one loop in the at least one electro-functional yarn enables ends portions of the electro-functional yarn to be selectively pulled and tensioned, so as to shorten the length of the loop and draw out the end portions of the at least one electro-functional yarn such that they project longitudinally outward of the cut ends of the textile sleeve. Such projecting end portions of the at least one electro-functional yarn may serve as leads for connection to a power source.

In one application of such a textile sleeve structure, the at least one electro-functional yarn may comprise a plurality of electrically resistive wires woven into the textile sleeve structure with one or multiple loops in the wires. After cutting the textile sleeve and plurality of electrically resistive wires to length in a simultaneous single cutting operation, the ends of the resistive wires aligned with the ends of the sleeve are selectively pulled axially outwardly from the sleeve and the wires are tensioned to draw out end portions of the wires so that the end portions project axially beyond the cut ends of the textile sleeve. Such a sleeve may be wrapped, for example, about a fluid conveying tube and when the end portions of the wires are coupled with the power source, the wires may generate resistive heat that is imparted to the tube so as to heat the fluid passing through the tube.

The at least one electro-functional yarn may be woven in the textile sleeve in such manner that the majority of the electro-functional yarn is disposed inwardly of an inside surface of the textile sleeve. Such an arrangement shields and protects the electro-functional yarn from exposure to external elements, abrasion, etc., and serves to maximize contact area between the electro-functional yarn and the tubing or other article(s) that is wrapped within the sleeve, and thus maximizes the effectiveness of the electro-functional yarn if such is used as a heat resistive yarn for generating heat for transfer to the tubing or other article wrapped within the sleeve.

The textile sleeve may include heat-shapeable yarns in the weft or fill direction that are heat-set into a curled shape to impart a self-biased closing force to the sleeve that renders it self-wrapping.

A method of constructing a textile sleeve in accordance with the invention includes forming a wall having opposite edges extending in a lengthwise direction along a longitudinal axis by interlacing warp yarns that extend generally parallel to the longitudinal axis with weft yarns that extend generally transversely to the longitudinal axis. Further, interlacing at least one electro-functional yarn into the wall at interlaced nodes with the at least one electro-functional member extending along the lengthwise direction of the wall and forming at least one loop of the electro-functional member between adjacent interlaced nodes. Then, cutting the wall and the at least one electro-functional member to a desired length to form opposite ends of the sleeve and opposite ends of the at least one electro-functional member. Upon being cut, the at least one loop remains between the opposite ends of the sleeve to allow the ends of the at least one electro-functional member to be selectively pulled to take up at least some of the at least one loop to extend the pulled ends of the at least one electro-functional member outwardly from the cut ends of the wall, wherein the extended ends may serve as leads for attachment to a source of electrical power.

In accordance with another aspect of the method of construction, the method can further include performing the interlacing of the warp and weft yarns in a weaving process.

In accordance with another aspect of the method of construction, the method can further include heat-setting at least some of the weft yarns to bias the opposite edges into overlapping relation with one another.

In accordance with another aspect of the method of construction, the method can further include forming a plurality of the loops between the opposite ends of the sleeve with each of the loops being between different adjacent nodes with the loops having a combined length that is greater than a combined length of the nodes.

In accordance with another aspect of the method of construction, the method can further include interlacing a plurality of electro-functional yarns into the wall, and further yet, it can include spacing each of the electro-functional yarns generally equidistantly from one another between the opposite edges.

These and other features and advantages of the present invention will be more readily appreciated when considered in connection with the detailed description and accompanying drawings, in which:

BRIEF DESCRIPTION OF THE DRAWINGS

FIG. 3 is a longitudinal cross-sectional view of the sleeve of FIG. 1 shown prior to tensioning electro-functional yarn(s) within the sleeve;

FIG. 4 is a view similar to FIG. 3 shown after tensioning the electro-functional yarn(s) within the sleeve;

FIG. 5 is a fragmentary plan view of an interior surface of the sleeve before tensioning the electro-functional yarn(s);

DETAILED DESCRIPTION OF A PREFERRED EMBODIMENT

Figure 1:
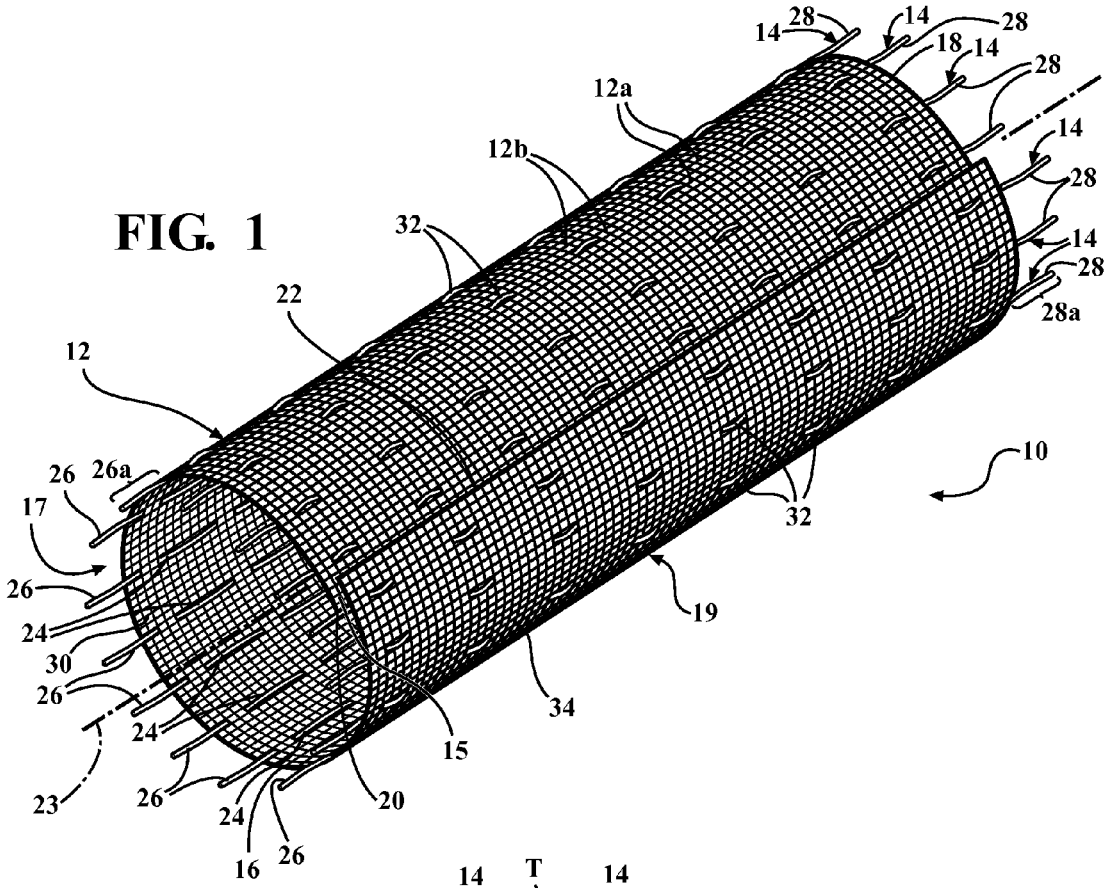
FIG. 1 is a perspective view of a textile sleeve constructed in accordance with one aspect of the invention.

FIG. 1 illustrates a textile sleeve 10 constructed in accordance with one embodiment of the invention having a plurality of textile yarns 12 and at least one electro-functional member, also referred to as electro-functional yarn 14 (conductive and/or resistive and/or data transmissive, etc.) interlaced into the sleeve 10. The sleeve 10 is generally tubular and split along its length by a seam 15 and wrapped upon itself to enclose an interior tubular space, also referred to as cavity 17.

The textile yarns 12 may be fabricated of any of a number of materials. Such materials include, but are not limited to: organic polymeric materials (plastics), natural fibers, miner fibers, metallic yarns, non-metallic yarns, and/or combinations thereof. The yarns 12 may be monofilament or may be multifilament or may be a combination of monofilament and multifilament. The textile yarns 12 may be of the same or different diameters or denier.

The at least one electro-functional yarn 14 may comprise a single strand of wire or a multifilament (e.g., braided, twisted, or served) structure, with the term "yarn" covering both mono and multi filament constructions of the electro-functional yarn 14. The electro-functional yarns 14 may comprise at least one of electrically conductive metallic material, electrically resistive metallic material, data transmissive material, and fiber optic material, or pluralities or combinations thereof. The electro-functional yarns 14 may be insulated or non-insulated or combinations thereof.

The textile yarns 12 are interlaced by weaving to form a wall 19 of the sleeve 10. A woven structural wall 19 of the textile yarns 12 is shown schematically in the drawings for making the textile sleeve 10, by way of example and without limitation. Some of the yarns, designated 12*a*, extend in the longitudinal lengthwise direction of the sleeve 10 between and to opposite sleeve ends 16, 18, wherein these yarns are generally referred to as warp yarns 12*a*. Some of the yarns, designated by 12*b*, extend in the cross-wise, circumferential direction of the sleeve 10, with these yarns generally being referred to as fill or weft yarns 12*b*. The sleeve 10 may be configured to be generally tubular in construction. This tubular shape of the sleeve 10 may be achieved by fabricating the wall 19 of the sleeve 10 having a width and length, and curling or wrapping the wall 19 of the sleeve 10 into the tubular shape. Such a sleeve 10 has the slit or seam 15, sometime referred to as an "open" sleeve construction, as illustrated in FIGS. 1 and 2, wherein the sleeve 10 is parted along its length by the seam 15 formed between overlapping first and second sleeve edges 20, 22 extending along a longitudinal central axis 23 between the opposite ends 16, 18, shown as being generally parallel to the longitudinal axis 23, wherein the fill yarns 12*b* extend generally between and to the edges 20, 22 transversely to the longitudinal axis 23.

Figure 2:
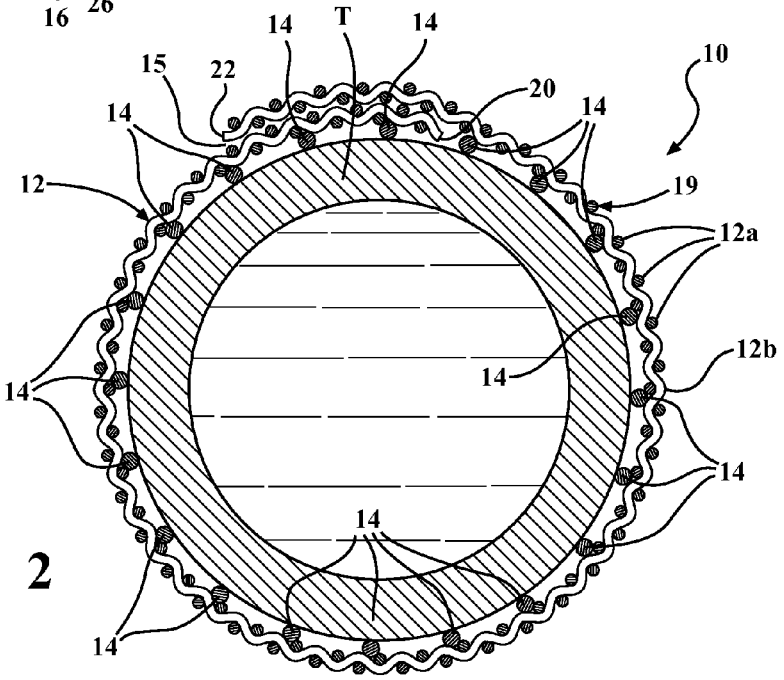
FIG. 2 is a cross-sectional view taken generally transversely to a central axis of the sleeve of FIG. 1 with the sleeve shown wrapped about a tube.
Figure 6:
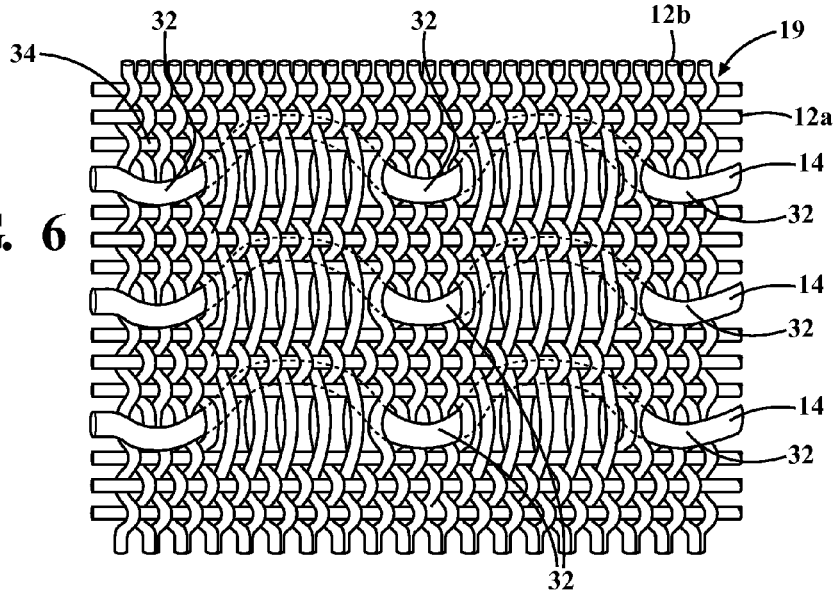
FIG. 6 is a fragmentary plan view of an outer surface of the sleeve of FIG. 1.

At least some of the fill yarns 12*b* may be fabricated of a heat-shapeable polymeric material, that are well known per se in the art, which enables the manufacture of the sleeve 10 to heat-set such fill yarns 12*b* of the wall 19 into a pre-curved or curled shape that self-biases the wall 19 of the sleeve 10 into a self-curled, closed tubular condition with the opposite edges 20, 22 overlapping one another such that the first edge 20 is radially inward of the radially outer second edge 22, as illustrated best in FIG. 2. FIG. 2 further shows the sleeve 10 wrapped about an article, in this case a fluid-conveying pipe or tube T, such as might be found in an engine compartment of a motor vehicle or aircraft, for example, to protect the tube T within the cavity 17 bounded by the wall 19. The sleeve 10 could similarly be wrapped about a bundle of wires or other articles.

Figure 7:
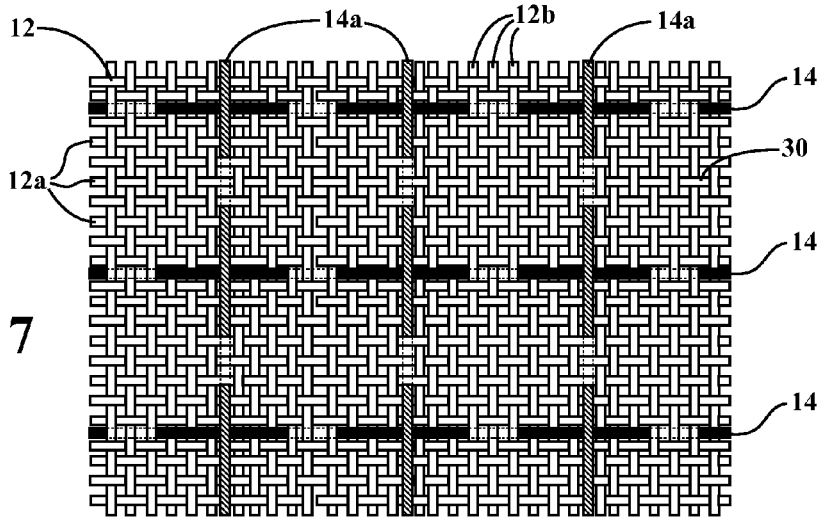
FIG. 7 is a fragmentary plan view of an interior surface of a sleeve constructed in accordance with another aspect of the invention.

FIGS. 3-6, illustrate further details of the construction of the woven sleeve 10. It will be observed that the at least one electro-functional yarn 14 extends in the lengthwise (warp) direction of the sleeve 10. As described below in greater detail, it is also contemplated that there may be one or more electro-functional yarns 14 in the weft or fill direction (FIG. 7 embodiment). It will be further observed with reference to FIGS. 3 and 4 that the at least one electro-functional yarn 14 is interlaced, such as by being woven, into the wall 19 of the textile sleeve 10 so as to form at least one free unrestrained loop or unconfined slackened portion 24 intermediate ends 26, 28 of the electro-functional yarn 14. The at least one electro-functional yarn 14 may be interlaced to include a plurality of such loops or slackened portions 24, as illustrated in FIGS. 3 and 4, wherein electro-functional yarns 14 can be spaced generally equidistantly from one another from one edge 20 to the opposite edge 22. Accordingly, an array of equidistantly spaced electro-functional yarns 14 may be provided to extend in generally parallel relation with one another about the circumference of the sleeve 10. As such, if the electro-functional yarns 14 are provided to produce heat, such as the case if they are resistive, a uniform heat distribution can be provided about the entire circumference of the sleeve 10, thereby uniformly heating the tube T therein. The loops 24 provide the electro-functional yarn 14 with a greater true length (i.e., the length of the electro-functional yarn 14 if on its own and pulled straight and taught) than that of the textile warp yarns 12*a*, even though the effective length (the straight length spanned) of the electro-functional yarns 14 and warp yarns 12*a* may be the same when in the "as initially woven" state, as illustrated in FIG. 3. The loops 24 project outwardly of the textile sleeve 10 by a loop height H. The loops 24 may project (or stand up) from an inside or inner surface 30 of the textile sleeve 10. Between neighboring loops 24, the electro-functional yarn 14 is interlaced with the textile sleeve material 12 (i.e., is laced via the weaving process with the textile fibers 12) at interlaced portions or nodes 32 which extend to an outside or outer surface 34 of the sleeve 10. As can be seen from FIGS. 1 and 3-6, the collective length of the loop portions 24 present on the inside 30 of the sleeve 10 is much greater than the collective length of the interlaced portions 32 present on the outside 34 of the sleeve 10. It may be advantageous to maximize the amount of the electro-functional yarn 14 present on the inside 30 of the sleeve 10 and to minimize the amount of the electro-functional yarn 14 present on the outside 34 of the sleeve 10, thereby minimizing the potential for damage to the electro-functional yarn 14 due to abrasion or other external environment conditions. The ratio of inside true length of the electro-functional yarn 14 to outside true length of the electro-functional yarn 14 is greater than 1:1 and may range to 50:1 or more, with the limit being the amount necessary to properly secure (interlace) the electro-functional yarn 14 to the sleeve 10 and provide the proper amount of support to the inside loop portions 24 between anchor nodes 32.

The height H of the loops 24 and/or number of loops 24 may be adapted and adjusted to provide more or less slackened material of the electro-functional yarn 14 on the inside 30 of the sleeve 10. As will be explained further below, after the sleeve 10 is woven and cut to length, the ends 26, 28 of the electro-functional yarns 14 are pulled or tensioned to draw out some or all of the loop or slack 24 and cause end portions 26*a*, 28*a* of the electro-functional yarn 14 to project axially outwardly from the sleeve 10 to serve as electrical connections or leads. The length of projection 26*a*, 28*a* may be controlled by the number and/or height of the loops 24, since this is where the slack comes from in order to extend the electro-functional yarn 14 to an effective longer length after cutting.

Once the textile sleeve 10 has been woven to include the one or more electro-functional yarns 14 with inner loops 24 formed between adjacent outer anchored points, also referred to as node portions, interlaced nodes or simply nodes 32, the sleeve 10 may be cut to a desired length L1 of the sleeve 10 as measured between the opposite longitudinal ends 16, 18. The nodes 32 are formed by the electro-functional yarns 14 being looped over at least one weft yarn 12*b*, whereupon the inner loops 24 generally span a plurality of weft yarns 12*b* prior to the formation of the next node 32, such that a plurality of weft yarns 12*b* are present between adjacent nodes 32. Before or after cutting, the sleeve 10 may be heat-shaped to impart a self-closing bias or curl to the sleeve 10, as illustrated in FIGS. 1 and 2. Alternatively, the woven material 19 may be generally flat and may be wrappable with application of an external force to the shape of the tubular sleeve 10 and may be retained by hook and loop closures, tape, bands or other closure means, as desired.

Figure 8:
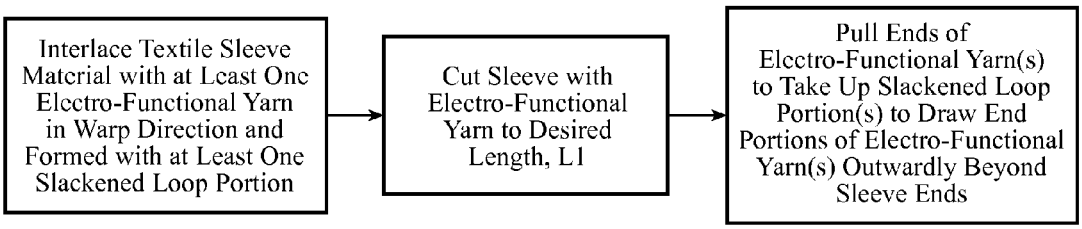
FIG. 8 is a flow chart of a method of making a sleeve in accordance with a further aspect of the invention.

After cutting the sleeve 10 to the desired length L1, the electro-functional yarns 14 may be grasped at each end 26, 28 and pulled taught so as to tension the yarns 14 with sufficient force to take up some or all of the slack of the loops 24, causing end portions 26*a*, 28*a* to be drawn outwardly so as to project axially outwardly from the sleeve 10. These end portions 26*a*, 28*a* may extend longitudinally from the cut ends 16, 18 of the sleeve 10, and may serve as electrical leads for connection with a power source P. A comparison of FIGS. 3 and 4 illustrates the slack from the loops 24 that is present in the electro-functional yarn 14 in the "as-woven and cut" state of the sleeve 10 versus when the slack of the loops 24 is taken up. FIG. 4 illustrates the action of pulling on the ends 26, 28 of the electro-functional yarns 14 to take up the loops 24 and draw the extended end portions 26*a*, 28*a* of the electro-functional yarns 14 from the sleeve 10. FIG. 8 is a flow chart of the method of construction or making steps. A lesser length of the extended portions 26*a*, 28*a* could be achieved by decreasing the height H of the loops 24 and/or decreasing the number of loops 24, and vice versa to lengthen the end portions 26*a*, 28*a*.

FIG. 4 also illustrates that the vast majority of the electro-functional yarns 14 within the longitudinal boundary confined between the ends 16, 18 of the sleeve 10 is present on the inside surface 30 of the sleeve 10 for greatest impact on protecting the yarns 14 and also on their ability to transfer heat directly to the tube T given their proximity and contact therewith in the event the yarns 14 are electrically resistive and employed to heat the tube T and the fluid therein.

An alternative embodiment is illustrated in FIG. 7, wherein additional electro-functional yarns 14*a* are added in the weft or fill direction of the woven sleeve 10. If used for heating the tube T, for example, the weft electro-functional yarns 14*a* may cross and physically contact the warp electro-functional yarns 14, and both 14, 14*a* may be non-insulated to create a grid or network of electro-functional yarns 14, 14*a* for greater heating capacity.

The foregoing description is exemplary rather than limiting in nature. Variations and modifications to the disclosed embodiment may become apparent to those skilled in the art are herein incorporated within the scope of the invention, which is ultimately defined by the claims.

What is claimed is:

1. A wrappable textile sleeve, comprising:

a wall of interlaced yarn having opposite outer and inner surfaces and opposite edges extending lengthwise along a longitudinal axis of the sleeve between opposite ends with a straightened length of said wall spanning between said opposite ends, said opposite edges being wrappable into overlapping one another to form a tubular cavity; and at least one electro-functional member extending along said longitudinal axis between said opposite ends, said at least one electro-functional member being interlaced in said wall at a plurality of nodes and forming at least one unrestrained loop intermediate said opposite ends, said at least one electro-functional member having a straightened length that is greater than said straightened length of said sleeve, thereby allowing opposite ends of the at least one electro-functional member to be pulled axially outwardly away from said opposite ends of said sleeve to form leads for attachment to a power source, which in turn reduced the size of said at least one loop.

2. The wrappable textile sleeve of claim 1 wherein said at least one unrestrained loop extends inwardly from said inner surface.

3. The wrappable textile sleeve of claim 2 wherein said at least one unrestrained loop includes a plurality of unrestrained loops.

4. The wrappable textile sleeve of claim 2 wherein said plurality of nodes are exposed on said outer surface.

5. The wrappable textile sleeve of claim 4 wherein said plurality of loops have a combined length that is greater than a combined length of said plurality of nodes.

6. The wrappable textile sleeve of claim 1 wherein said at least one electro-functional member includes a plurality of electro-functional members.

7. The wrappable textile sleeve of claim 6 wherein said plurality of electro-functional members are generally equidistantly spaced from one another between said opposite edges.

8. The wrappable textile sleeve of claim 1 wherein said at least one electro-functional member is at least one of an electrically conductive metallic material, electrically resistive metallic material, data transmissive material, and fiber optic material.

9. The wrappable textile sleeve of claim 1 wherein said interlaced yarn includes warp yarn extending generally parallel to said longitudinal axis and weft yarn extending generally transversely to said longitudinal axis, at least some of said weft yarn being heat-settable.

10. The wrappable textile sleeve of claim 9 wherein said interlaced yarns are woven.

11. The wrappable textile sleeve of claim 10 wherein said at least one electro-functional member is looped over at least one of said weft yarns at each of said nodes.

12. A method of constructing a wrappable textile sleeve, comprising:

forming a wall having opposite edges extending in a lengthwise direction along a longitudinal axis by interlacing warp yarns that extend generally parallel to the longitudinal axis with weft yarns that extend generally transversely to the longitudinal axis;

interlacing at least one electro-functional yarn into the wall at interlaced nodes with the at least one electro-functional member extending along the lengthwise direction of the wall and forming at least one loop of the electro-functional member between adjacent interlaced nodes; and cutting the wall and the at least one electro-functional member to a desired length to form opposite ends of the sleeve and opposite ends of the at least one electro-functional member with the at least one loop remaining between the opposite ends of the sleeve to allow the ends of the at least one electro-functional member to be selectively pulled to take up at least some of the at least one loop to extend the pulled ends of the at least one electro-functional member outwardly from the cut ends of the wall, wherein the extended ends may serve as leads for attachment to a source of electrical power.

13. The method of claim 12 further including performing the interlacing of the warp and weft yarns in a weaving process.

14. The method of claim 12 further including heat-setting at least some of the weft yarns to bias the opposite edges into overlapping relation with one another.

15. The method of claim 12 further including forming a plurality of the loops with each of the loops being between different adjacent nodes.

16. The method of claim 15 further including forming the plurality of loops having a combined length that is greater than a combined length of the plurality of nodes.

17. The method of claim 12 further including interlacing a plurality of electro-functional yarns into the wall.

18. The method of claim 17 further including spacing each of said electro-functional yarns generally equidistantly from one another between the opposite edges.

19. The method of claim 12 further including providing the at least one electro-functional member as at least one of an electrically conductive metallic material, electrically resistive metallic material, data transmissive material, and fiber optic material.

20. The method of claim 12 further including looping the at least one electro-functional member over at least one of said weft yarns at each of the nodes.

* * * * *